United States Patent [19]

Ikemoto et al.

[11] 4,426,148

[45] Jan. 17, 1984

[54] MOUNTING STRUCTURE FOR DEVELOPING UNIT WITH A MAGNETIC BRUSH

[75] Inventors: Isao Ikemoto; Akihiko Tamura, both of Hachioji, Japan

[73] Assignee: Konishiroku Photo Industry Co., Ltd., Tokyo, Japan

[21] Appl. No.: 331,253

[22] Filed: Dec. 16, 1981

[30] Foreign Application Priority Data

Dec. 26, 1980 [JP] Japan ..... 55-186486[U]

[51] Int. Cl.[3] ..... G03G 15/00

[52] U.S. Cl. ..... 355/3 DD; 355/14 D; 355/3 R; 118/658

[58] Field of Search ..... 355/3 DD, 3 R, 14 D, 355/14 R; 118/658; 430/94, 135

[56] References Cited

U.S. PATENT DOCUMENTS

| | | | |
|---|---|---|---|
| 4,258,113 | 3/1981 | Kuehnle | 430/94 |
| 4,325,626 | 4/1982 | Murata et al. | 355/3 DR |
| 4,350,750 | 9/1982 | Suzuki et al. | 355/3 DR X |
| 4,370,051 | 1/1983 | Matsuyama et al. | 355/3 DR X |

*Primary Examiner*—A. C. Prescott

*Attorney, Agent, or Firm*—Jordan B. Bierman; Linda Bierman

[57] ABSTRACT

The distance between the photosensitive drum and the developing sleeve of a copier is kept accurately constant by confronting surfaces on the mounting structures. The confronting surfaces can be in the shape of a circular arcs whose centers are in the center of the corresponding drum or developing sleeve.

2 Claims, 3 Drawing Figures

MOUNTING STRUCTURE FOR DEVELOPING UNIT WITH A MAGNETIC BRUSH

BACKGROUND OF THE INVENTION

1. Field of the Invention

The present invention relates to the developing unit with a magnetic brush used for an electrophotographic copying machine, for example, and more particularly to the structure to mount said developing unit on the machine body.

2. Description of the Prior Art

An ordinary developing unit with a magnetic brush has a structure shown in FIG. 1. And inside the developing box 2 that is fixed to the machine body etc. in the position opposite to the photosensitive substance drum 1, there are provided the developing sleeve 4 having permanent magnets 3 therein, the stirring blades 5 and a doctor blade 6. In the developing unit with a magnetic brush of such a structure, therefore, the ear of the developer regulated by the doctor blade 6 is formed on the circumferential surface 4*a* of the developing sleeve 4 and electrostatic latent iamges on the circumferential surface 1*a* of the photosensitive substance drum 1 are developed by toner in the developing area A. Consequently, the minimum distance d between the circumferential surface 1*a* of the photosensitive substance drum 1 and the circumferential surface 4*a* of the developing sleeve 4 commands the developing efficiency of the developing unit and it has an important meaning. In the case the developer containing coating carrier whose surface is coated with insulating resin is used, the value of the minimum distance d is 1.0–2.0 mm at most and the dimensional accuracy thereof is a very severe one such as ±0.05–0.1 mm when it is intended ot obtain an image with good quality.

Conventionally, by the way, for the purpose of getting accurate value of the minimum distance there have been taken countermeasures such as the method to obtain necessary dimension by inserting spacers to the mounting seat of the machine frame to which the developing box 2 is mounted or the method wherein the driven rollers for positioning are supported by the developing box 2 and these driven rollers are contacted to the circumferential surfaces at the ends of the photosensitive substance drum. However, the former countermeasure has a drawback that the difficult assembly work to insert the thickness guauge etc, in the narrow distance d is required and the reproducibility is detracted when dismounting and mounting the developing unit and consequently the adjustment should be amde again. Compared with this, the latter countermeasure has a merit that the assembly work is easy and the reproducibility is good but it has a drawback that the use of special driven rollers is needed in order to keep the potential between the surface of the photosensitive substance drum and the developing unit and unnecessary length is required to the length of the photosensitive substance drum because the circumferential surfaces at the ends of the photosensitive substance drum will become inefficient and consequently the entire apparatus will become bulky.

SUMMARY OF THE INVENTION

In the light of the drawbacks of the mounting structure for the conventional developing unit mentioned above, the present invention is to offer the mounting stucture for the developing unit with a magnetic brush wherein the necessary distance between the photosensitive substance drum and the developing sleeve can be obtained without the necessity of adjustment only by mounting the developing unit and the unit in dimension will not be bulky. Namely the present invention is to offer the mounting structure for the developing unit with a magnetic brush wherein a confronting surface whose distance from the center of photosensitive substance drum is kept accurately is formed on the surface of each of mounting plates for the drum.

DESCRIPTION OF THE PREFERRED EMBODIMENT

Figure 1:
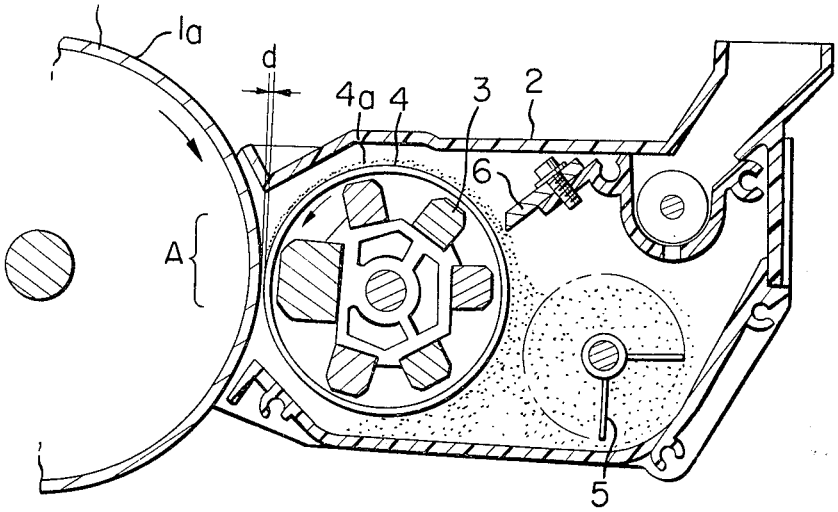
FIG. 1 is a cross-sectional view of the conventional developing unit with a magnetic brush.
Figure 2:
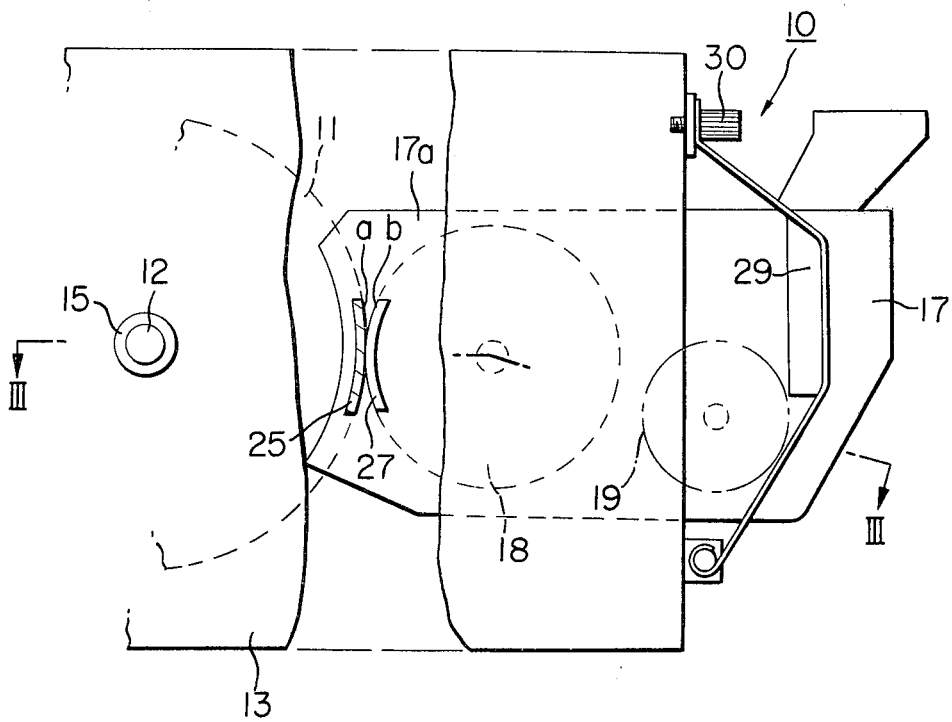
FIG. 2 is a side view with a partial sectional view of the developing unit with a magnetic brush wherein the present invention is applied and FIG. 3 is a cross-sectional view along the III—III line of FIG. 2.
Figure 3:
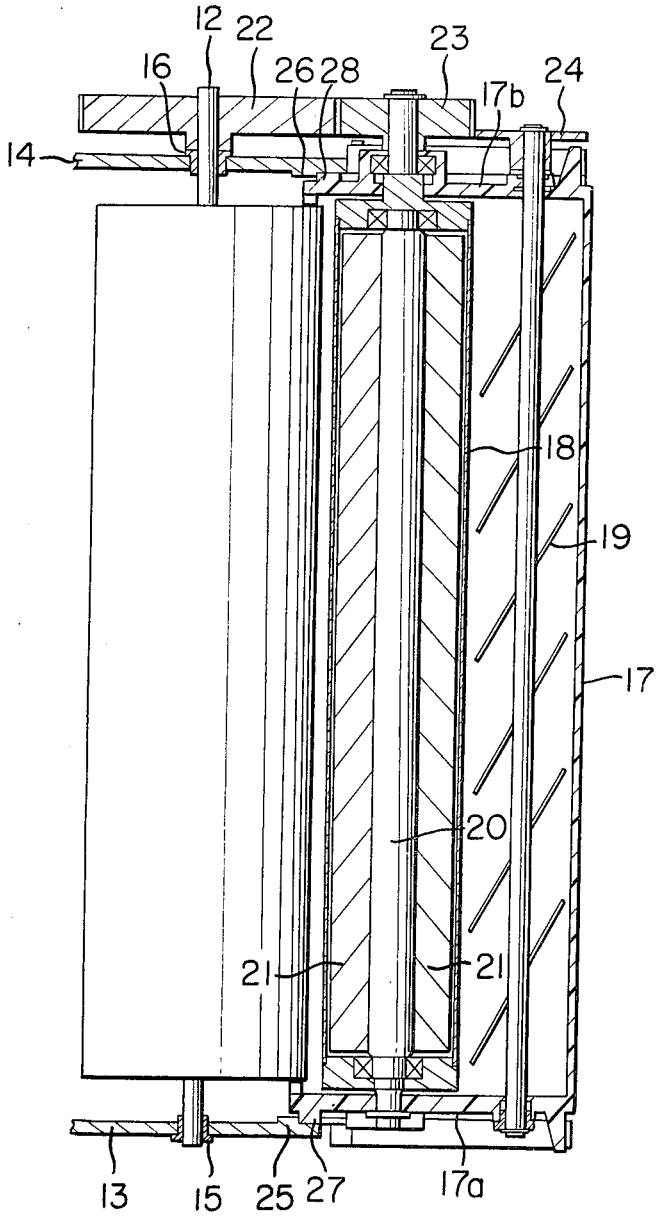

Referring to FIG. 2 and FIG. 3, the detail of the present invention will be explained as follows.

FIG. 2 and FIG. 3 show the surrounding area of the photosensitive substance drum 11 to which the unit with a magnetic brush 10 is fixed. The central axle 12 of the photosensitive substance drum 11 is arranged between the bearings 15 and 16 on a pair of mounting plates 13 and 14. The developing unit with a magnetic brush 10 has, within itself, the developing sleeve 18 and the stirring blade 19 both arranged between side walls 17*a* and 17*b* of the developing box 17 in which the developer is contained, and in aforesaid developing sleeve 18, plural permanent magnets 21 arranged around the supporting shaft 20 are located. Aforesaid developing sleeve 18 and stirring blade 19 are rotated synchronously with the photosensitive substance drum 11 by the driven gears 23 and 24 which are driven by the synchronous gear 22 fixed at the end of the central axle 12.

According to the present invention, the protrusions 25 and 26 in the shape of the circular arc whose center is aforesaid central axle 12 are protruded inside aforesaid mounting plates 13 and 14 and an external circumferential surface of each of these protrusions 25 and 26 in the shape of a circular arc corresponds to the confronting surface a (FIG. 2) whose distance from the central axle 12 namely from the center of the photosensitive substance drum 11 is accurately finished. On the external side faces of aforesaid developing box 17, on the other hand, the protrusions 27 and 28 in the shape of a circular arc whose center is same as the center of aforesaid developing sleeve 18 are protruded. The external circumferential surfaces of these protrusions 27 and 28 in the shape of a circular arc correspond to contacting surfaces b (FIG. 2) whose distance from the center of the developing sleeve 18 is accurately finished. Therefore, when the developing unit 10 with a magnetic bursh is mounted on the machine body, the relation between the photosensitive substance drum 11 and the developing sleeve 18 can be established so that a minimum distance d with necessary accuracy for good quality of image is assured only by contacting the contacting surface b to the confronting surface a. Thereby, after the contacting surface b, the assembly can be completed only by fixing the developing box 17 to the mounting plates 13 and 14 with the use of an elastic band 29 and a set screw 30.

As is clear from the foregoing explanation, it is possible to obtain the mounting structure with good reproducibility without the necessaity of any adjustment work and the mounting structure of the present invention can be attained only by forming the confronting surfaces and the contacting surfaces on the mounting plates and the developing box respectively and therefore an excellent effect such as that the unit in dimension will not be bulky etc, is expected.

According to the present invention, the shape of the confronting surfaces and the contacting surfaces on the mounting plates should not always be circular arc.

What is claimed is:

1. In a structure wherein a photosensitive substance drum is arranged between a pair of mounting plates that oppose each other, a mounting structure for a developing unit with a magnetic brush wherein a confronting surface whose distance from the center of said photosensitive substance drum is kept accurately is formed on the surface of each of said mounting plates and a contacting surface whose distance from the center of a developing sleeve of said magnetic brush is kept accurately is formed on the surface of a developing box for the developing unit with a magnetic brush and the distance between the circumferential surface of the photosensitive substance drum and the circumferential surface of the developing sleeve is obtained by making said confronting surface and said contacting surface contact.

2. Mounting structure as set forth in claim 1 wherein the confronting surface is in the shape of a circular arc whose center is the center of the drum and the contacting surface is in the shape of a circular arc whose center is the center of the developing sleeve.

* * * * *